United States Patent [19]

Hawkins

[11] Patent Number: 4,598,297

[45] Date of Patent: Jul. 1, 1986

[54] MOUNTING APPARATUS FOR SATELLITE DISH ANTENNAS

[76] Inventor: Joel W. Hawkins, P.O. Box 3867, Greenville, S.C. 29608

[21] Appl. No.: 544,285

[22] Filed: Oct. 21, 1983

[51] Int. Cl.[4] ..... H01Q 3/08

[52] U.S. Cl. ..... 343/882

[58] Field of Search ..... 343/878, 915, 880–882, 343/757, 840, 765, 766; 248/184, 183, 122

[56] References Cited

U.S. PATENT DOCUMENTS

| | | | |
|---|---|---|---|
| 2,298,880 | 10/1942 | Gartenmeister | 343/915 |
| 4,232,320 | 11/1980 | Savalle | 343/765 |
| 4,454,515 | 6/1984 | Major et al. | 343/882 |
| 4,475,110 | 10/1984 | Hutchins | 343/882 |
| 4,506,271 | 3/1985 | Gonzalez | 343/915 |

FOREIGN PATENT DOCUMENTS

| | | | |
|---|---|---|---|
| 2702340 | 7/1978 | Fed. Rep. of Germany | 343/765 |
| 54-37661 | 3/1979 | Japan | 343/882 |
| 55-50704 | 4/1980 | Japan | 343/765 |

*Primary Examiner*—Eli Lieberman
*Assistant Examiner*—Michael C. Wimer
*Attorney, Agent, or Firm*—Bailey & Hardaway

[57] ABSTRACT

Mounting apparatus is illustrated for a TV satellite dish antenna wherein nonbinding adjustment means are provided for accommodating the dish antenna for use in particular geographical location, and wherein means are provided for mounting dish antennas upon a tiltable frame wherein bracket supports are adjustable so that a leg may be accommodated in tangential relation to any selected dish size and configuration.

5 Claims, 5 Drawing Figures

MOUNTING APPARATUS FOR SATELLITE DISH ANTENNAS

BACKGROUND OF THE INVENTION

Mounting apparatus of the type commonly utilized on satellite dish antennas often do not have any means of accommodating the tiltable mechanism for aiming the antenna at a selected satellite to a particular geographical location. Those which do utilize adjustable mounting brackets carried by means such as a Heim ball joint on one end, which twists the mounting bracket in such a way that the distortion is magnified as the tilting of the dish supporting frame in respect to a neutral position becomes more pronounced.

Another problem occurs in the installation of such inexpensive supports, as for home use, resulting from the fact that parabolic dish antennas have varying sizes and curvatures. In order to accommodate the various dish configurations, the fixed mounting brackets must be twisted and unless the resulting disformation of the bracket is of substantially the required magnitude, the leg, which is secured to the antenna, is not substantially tangential thererto. Unless the bracket is square or tangential, stresses are induced into the dish antenna, when the fastening means between the bracket and the dish is secured, which distort the curvature resulting in poor reception of the signal.

The following U.S. Letters Patent, in addition to the prior art constructions described above, are representative of the prior art: U.S. Pat. Nos. 2,258,186, 3,553,732, 3,714,660, 3,999,184, 3,940,771, 4,104,640, 4,232,319, 4,209,789 and 4,232,320.

Accordingly, it is an important part of this invention to provide a simplified and inexpensive mounting structure for a dish antenna which provides a readily adjustable means for accommodating the tiltable frame to a motion which conforms to the requirements of geographical location.

Another important object of the invention is to provide a means for mounting the dish antenna upon the tiltable frame in such a way that the bracket may be adjusted in planes at right angles to each other as well as vertically in such a way as to provide simnplified means for securing the dish antennas without placing substantial stresses thereon as to distort the antenna interferring with the reception of the signal.

Another advantage of the invention resides in the provision of an inexpensive antenna mounting apparatus having separate bracket mountings which may be broken down for convenient packaging and shipping and which may be readily assembled and installed.

SUMMARY OF THE INVENTION

It has been found that means may be provided for accommodating the tilting mechanism of an antenna support for a particular geographical location by providing a piggy back mechanism, wherein first and second bracket devices are provided for pivoting the tiltable frame in the same vertical plane together with a bracket interposed therebetween, which is pivotal about an axis in alignment with a first of said tiltable means. A means is also provided for mounting a dish antenna upon the tiltable frame which employs a vertical bracket including an upwardly extending member having an outwardly projecting leg on a free end thereof for supporting the dish antenna in substantial tangential relationship thereto. A rotatably adjustable collar is provided for carrying the bracket adjacent an opposite end for adjustment in one plane, whereas a fastening means extension through a slot in the bracket provides adjustment at right angles thereto as well as vertical adjustment with respect to the collar.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
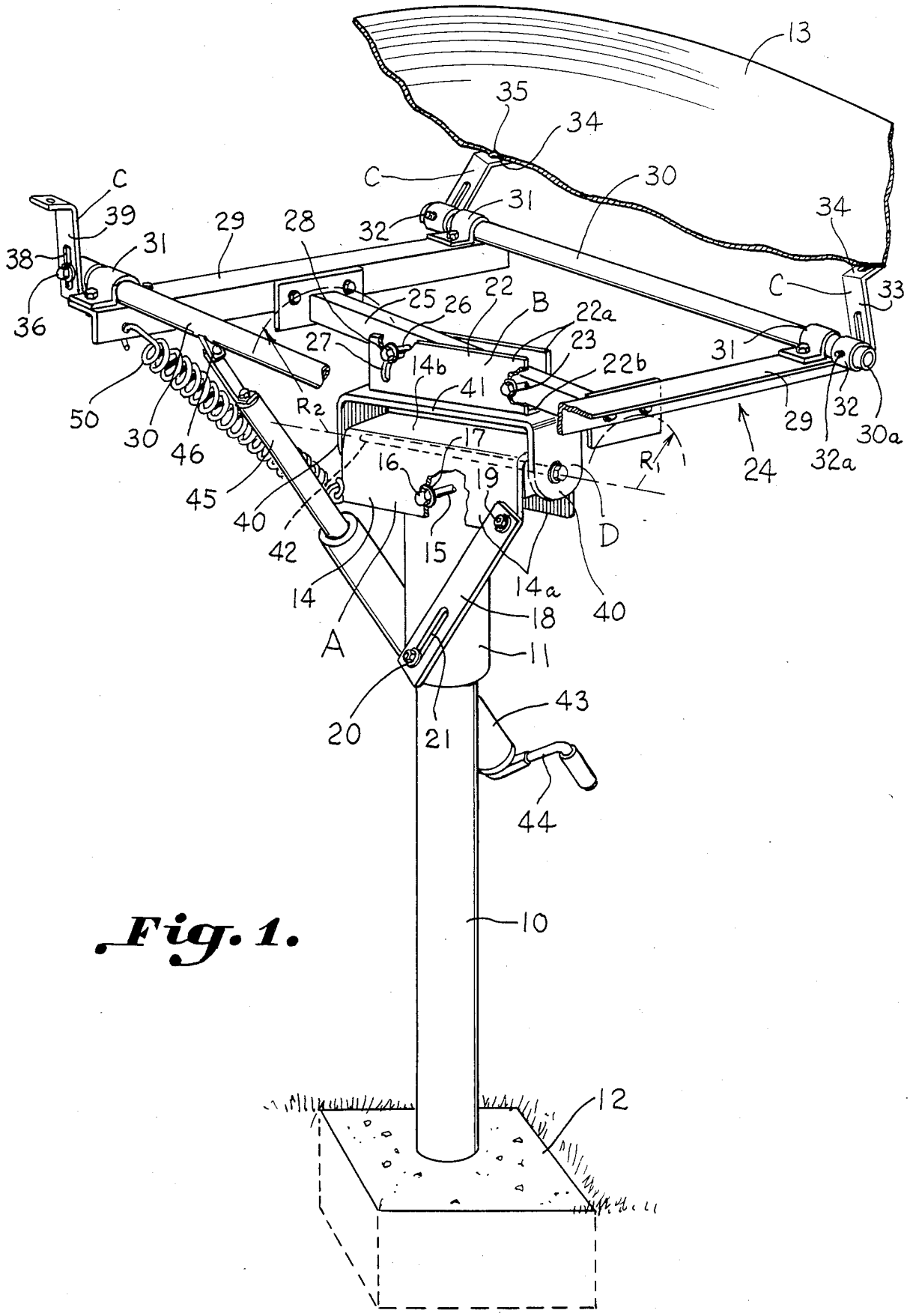
FIG. 1 is a perspective view illustrating a mounting means for a TV dish antenna constructed in accordance with the present invention, illustrating both the means for geographical adjustment of a tiltable mounting frame as well as the means for accommodating the dish in combination therewith.
Figure 2:
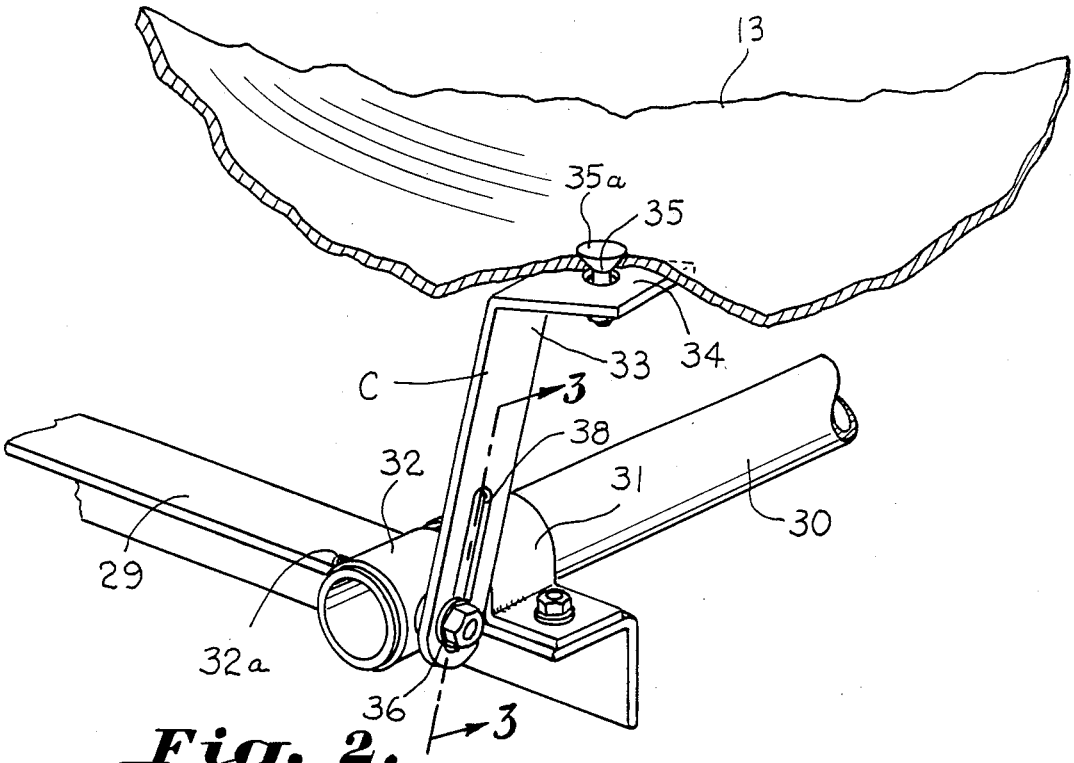
FIG. 2 is an enlarged perspective view illustrating mounting means for accommodating the dish antenna to the tiltable frame.

The drawings illustrate a mounting apparatus for a satellite dish antenna having a post, a tiltable frame for mounting the dish antenna carried by the post, and extensible means having connection between the post and the frame for imparting a tilting motion to the frame. A first vertically tiltable support A is carried by the post. A second vertically tiltable support B is carried by the first vertically tiltable support for effecting an angular adjustment with the first vertically tiltable support. Means C are provided for mounting the dish upon the tiltable frame. Tiltable adjusting means D move the frame in a plane extending across the first and second adjustable supports responsive to movement of the extensible means.

The mounting apparatus is illustrated as including a post 10 which includes a cap 11 on an upper end. A suitable base such as a poured concrete footing is illustrated at 12. While the mounting apparatus is illustrated as being carried by a post mounted in the ground, the apparatus may be utilized on any suitable supporting device. The dish antenna is illustrated at 13 and may be of any suitable curved or parabolic configuration for implementing its purpose as an antenna. Such curvature varys and has heretofore created a problem in providing a mounting apparatus capable of accommodating dish antennas of various manufacture, sizes and designs.

The drawing illustrates the position of a first tiltable support A upon the cap 11. The tiltable support A includes a bracket 14, having a pair of depending legs **14*a* carried by a web member 14*b*. The bracket 14 is pivoted as upon a horizontal shaft 15 which may be threaded on the ends to receive a nut 16 and washer 17. The first vertically tiltable support bracket 14 may be secured in a desired tilted position by fixing the position of a link 18 which is pivotally, carried on one end upon one of the depending legs 14***a* as at 19 by tightening the nut 20, which forms a part of the fastening means which extends through the slot 21 into the cap 11.

A second vertically tiltable support B includes a bracket member 22, which has upwardly extending legs 22*a* and a bridging web member 22*b*. A horizontal shaft 23 extends and is supported between the upstanding legs 22*a* in order to provide a pivotal mounting for the frame broadly designated at 24. The frame 24 includes a supporting member 25 which is pivoted as at 23. A shaft 26 extends through the member 25 and through arcuate slot 27 in each of the legs 22*a*, so that the frame may be pivoted as at 23 and fixedly secured as at 26. The threaded nuts 28 are provided for fixing the position of the frame 24 with respect to the bracket 22.

Thus, the pivotal position of the first vertically tiltable support A may be adjusted about the axis formed by the horizontal shaft 15 by manipulation of the nut 20 as described above. Adjustment accommodating the tiltable frame 24 to a motion which conforms to the requirements of a geographical location may be made by manipulating the threaded nuts 28 as described above to fix the distances $R_1$ and $R_2$ described below. These distances would remain constant for the geographical location during the movement of the frame 24 about the axis formed by the shaft 42 in response to manipulation of the extensible means 43 as described below for satellite selection.

Figure 3:
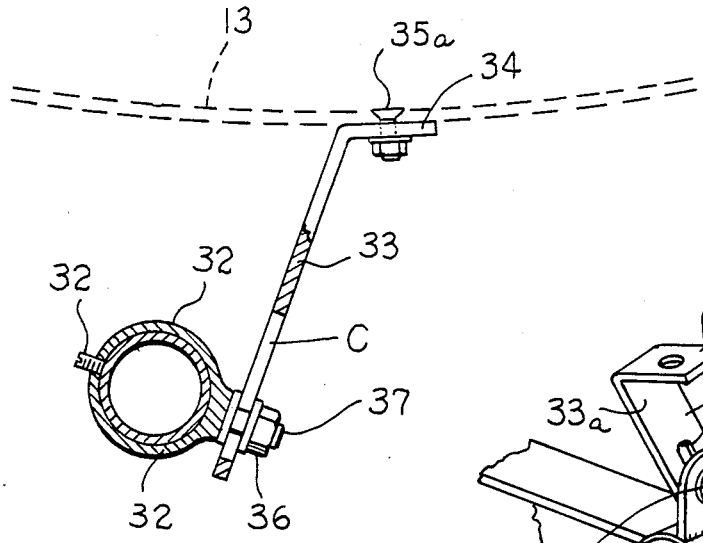
FIG. 3 is a transverse sectional elevation taken on the line 3—3 in FIG. 2.

The tiltable frame, which carries the dish antenna 13, includes a pair of parallel sides 29 which are suitably connected and braced by the member 25. A pair of end frame members are formed for the tiltable frame 24 as by the tubular members 30. The tubular members 30 have outwardly projecting ends 30*a*, which extend beyond the mounting brackets 31. The tubular mounting ends 30*a* have mounting collars 32 rotatable for adjustment thereon, which serve as a part of the mounting means C. The collars 32 are secured as by set screws 32*a* to the tubular portions 30*a* and provide adjustment for the bracket 33 in one direction. The bracket 33 has an outwardly extending leg 34 which has a fastening bolt 35 having a tapered head 35*a*, for securing the leg 34 in a substantially tangential relation to the dish. Vertical adjustment is provided by the fastening means 36 which includes a threaded shank 37 which passes into the mounting collar 32 (FIG. 3). A portion of shank 37 passes through the vertical slot 38 in the vertical portions or standards 39.

It will be observed that a tiltable adjusting means D is provided for tilting the frame about the firm support A in a plane across the first and second adjustable supports. The means D includes a mounting bracket having depending end portions 40 and an intermediate connecting member 41. The end members 40 form a pivotal support for the frame 24 intermediate the first and second vertically tiltable supports a A and B, respectively. A shaft illustrated at 42 (FIG. 1) is illustrated as being in alignment with the first and second tiltable supports acts as a pivotal support for the frame 24 which moves in response to the manually operated extensible means 43. The extensible means 43 is operated by turning the hand crank 44, which through threadable means (not shown) extends or retracts the extensible member 45, which has pivotal connection with an end frame member 30 as at 46. A housing of the extensible means 43 is pivotally connected as at 47 for universal pivotal movement upon the cap 11 for normally urging the frame 24 against the force of the spring 50 for positively positioning the frame by tiling same about a longitudinal axis formed by the shaft 42 thus moving the tiltable adjusting means D and the secured support B across the first support. The tension spring 50 has connection between the bracket 14 on one end and the frame 24 on the other. Any suitable drive, such as an electric motor, may be provided as a substitute for the manually operated extensible member illustrated.

The path generated by the tiltable frame is defined by the position of the axis passing through the pivot point 23 and the shaft 26 and its relation to the axis of the shaft 42. The respective distances $R_1$ and $R_2$ at respective ends of the frame are so defined in order to accommodate the motion of the frame 24 in satellite selection to a particular geographical location.

Figure 4:
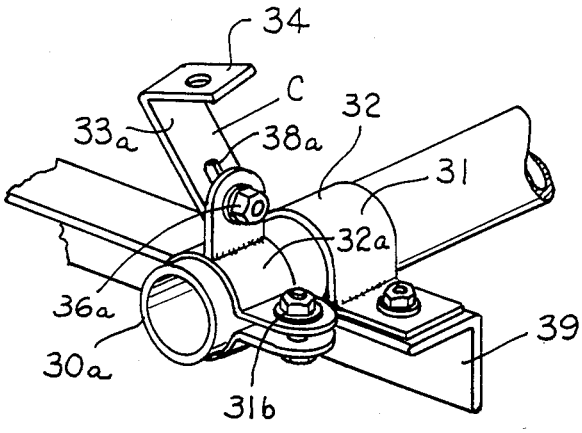
FIG. 4 is a perspective view illustrating the mounting means in accommodating the dish antenna constructed in accordance with a modified form of the invention.
Figure 5:
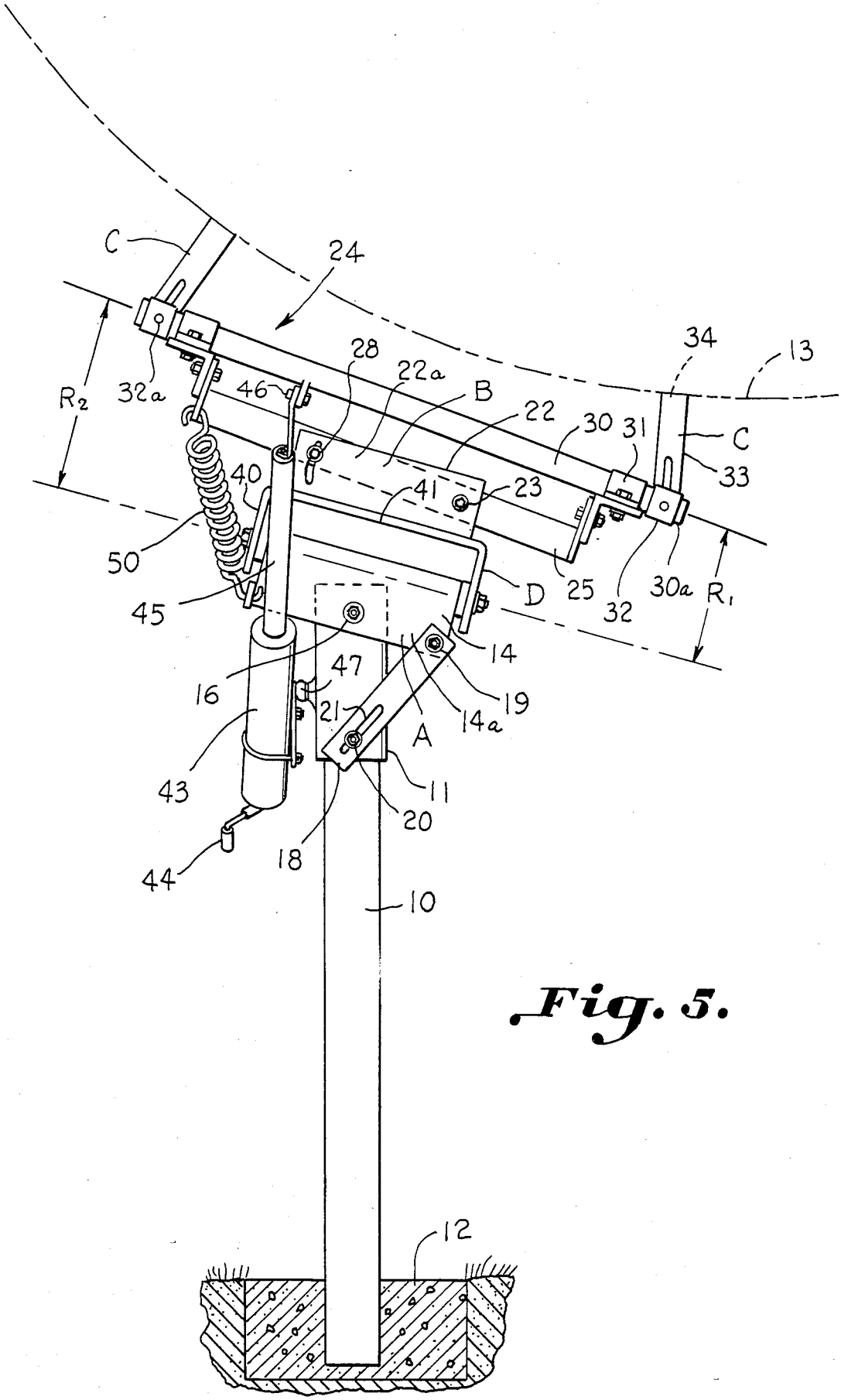
FIG. 5 is a side elevation further illustrating the mounting apparatus constructed in accordance with the invention in a neutural position in respect to satellite selection.

A modified form of the invention is illustrated in FIG. 4 wherein a collar 32*a* is secured to the mounting end 30*a* as by a clamping bolt 31*b*. The bracket has a standard 33*a* having a slot 38*a* secured by the bolt 36*a* carried by an upwardly extending tab carried by the collar 32*a*.

While a preferred embodiment of the invention has been described using specific terms, such description is for illustrative purposes only and it is to be understood that changes and variations may be made without departing from the spirit or scope of the following claims.

What is claimed is:

1. Mounting apparatus having a satellite dish antenna having a tiltable frame comprising:

a first support pivotably mounted about a first pivot axis;

a second support pivotally mounted on said first support about a second axis orthogonal to said first axis;

means mounting said tiltable frame and said dish antenna on said second support around a third pivot axis generally parallel to said first pivot axis;

locking means for locking said tiltable frame with respect to said second support; and means for adjusting said tiltable frame around said second axis.

2. The structure set forth in claim 1 including means mounting said dish antenna upon said tiltable frame comprising:

an inwardly extending bracket having a standard and a leg at an angle thereto for supporting said dish in tangential relation thereto;

a rotatably adjustable mounting collar carried by said frame, and means for vertically and pivotally adjusting said standard carried by said collar.

3. The structure set forth in claim 1 including means mounting said dish antenna upon said tiltable frame comprising: an upwardly extending bracket having a standard and a leg at an angle thereto for supporting said dish in tangential relation thereto, an adjustable mounting collar carried by said frame, and vertically slotted means for vertically and pivotally adjusting said standard carried by said collar.

4. The structure set forth in claim 1 wherein said means mounting said frame includes a horizontal pivot and a spaced, arcuate fastening means for securing said frame in fixed, vertically tilted positon about said horizontal pivot.

5. The structure set forth in claim 1 wherein said second support includes a U-shaped bracket straddling said first support.

* * * * *